US008165326B2

(12) United States Patent
Ohashi

(10) Patent No.: US 8,165,326 B2
(45) Date of Patent: Apr. 24, 2012

(54) SOUND FIELD CONTROL APPARATUS

(75) Inventor: Noriyuki Ohashi, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 860 days.

(21) Appl. No.: 12/184,812

(22) Filed: Aug. 1, 2008

(65) Prior Publication Data

US 2009/0034764 A1 Feb. 5, 2009

(30) Foreign Application Priority Data

Aug. 2, 2007 (JP) ..... 2007-201887

(51) Int. Cl.
*H04R 5/02* (2006.01)

(52) U.S. Cl. ..... 381/310

(58) Field of Classification Search ..... 381/61, 381/308–310, 300
See application file for complete search history.

(56) References Cited

U.S. PATENT DOCUMENTS 6,760,446 B1 * 7/2004 Miller ..... 381/1

FOREIGN PATENT DOCUMENTS

JP 11-46400 A 2/1999

* cited by examiner

*Primary Examiner* — Kimberly Lockett
(74) *Attorney, Agent, or Firm* — Crowell & Moring LLP

(57) ABSTRACT

In a sound field control apparatus, a storage unit stores position information of a plurality of speakers disposed in a three-dimensional space and position information of a sound receiving point. An input unit inputs an audio signal and position information of a virtual audio source. A localization controller localizes the audio signal at a position of the virtual audio source. The localization controller defines a virtual polyhedral solid that has vertices at respective positions of the plurality of the speakers, selects a face of the virtual polyhedral solid through which a directional line from the sound receiving point to the virtual audio source passes, selects speakers located at vertices of the selected face as speakers to which the audio signal is output, and determines ratios of levels of the audio signals to be provided to the speakers located at the vertices of the selected face based on ratios of respective angles between the directional line and straight lines directed from the sound receiving point to the vertices of the selected face.

4 Claims, 8 Drawing Sheets

SOUND FIELD CONTROL APPARATUS

BACKGROUND OF THE INVENTION

1. Technical Field of the Invention

The present invention relates to a sound field control apparatus that can sterically control localization of virtual audio sources in three dimensions.

2. Description of the Related Art

A multichannel audio system that includes a plurality of speakers at all sides in a listening room to reproduce a sound field providing realism through multiple channels has been suggested (for example, see Patent Document 1). In this type of conventional multichannel audio system, a plurality of speakers (generally, four speakers FL, FR, RL, and RR) is disposed in a plane. Therefore, even when the position of a virtual audio source of an audio signal is three-dimensional, it is converted into a two-dimensional distribution and the corresponding signal is distributed to two speakers to localize a sound image as a virtual audio source.

[Patent Document 1] Japanese Patent Application Publication No. 11-46400

However, a sound field reproduced by the conventional audio system provides a two-dimensional sensation different from a real-world sound field. That is, since the height of localization of the virtual audio source is not controlled, there is a problem in that a height sensation of the sound field is almost entirely fixed by a flat level arrangement of speakers.

Surround sound speakers are installed at high positions in addition to the four channel speakers in some recent surround sound audio systems that are on the market. However, these surround sound speakers only output sounds including environmental or background sounds to support the creation of a sound field and do not contribute to localization of an individual virtual audio source.

SUMMARY OF THE INVENTION

Therefore, it is an object of the invention to provide a sound field control apparatus that can sterically localize a sound image of each virtual audio source in three dimensions using a plurality of speakers disposed at different heights.

In accordance with a first aspect of the invention, there is provided a sound field control apparatus comprising: a storage unit that stores position information of a plurality of speakers disposed in a three-dimensional space and position information of a sound receiving point of sounds generated from the plurality of the speakers; an input unit that inputs an audio signal and position information of a virtual audio source at which the audio signal is to be localized; and a localization controller that localizes the audio signal at a position of the virtual audio source, wherein the localization controller defines a virtual solid that is approximately polyhedral and that has vertices at respective positions of the plurality of the speakers, selects a face of the virtual solid through which a directional line directed from the sound receiving point to the virtual audio source passes, selects speakers located at vertices of the selected face as speakers to which the audio signal is output, and determines ratios of levels of the audio signal to be provided to the speakers located at the vertices of the selected face based on ratios of respective angles between the directional line and straight lines directed from the sound receiving point to the vertices of the selected face.

In accordance with a second aspect of the invention, the storage unit stores position information of 8 speakers located respectively at vertices S1, S2, S3, S4, . . . of an approximately rectangular solid having six rectangles. The localization controller defines a first plane determined by the sound receiving point and a side S1-S2 of a rectangle S1, S2, S3, S4 corresponding to the selected face and a second plane determined by the sound receiving point and an opposite side S3-S4 of the rectangle S1, S2, S3, S4, defines a third plane determined by the position of the virtual audio source and a line of intersection between the first and second planes, defines an angle between the first plane and the third plane as a first decomposed angle of the directional line with respect to the vertices S1 and S2, and defines an angle between the second plane and the third plane as a first decomposed angle of the directional line with respect to the vertices S3 and S4, defines a fourth plane determined by the sound receiving point and a side S2-S3 of the rectangle S1, S2, S3, S4 and a fifth plane determined by the sound receiving point and a side S4-S1 of the rectangle opposite the side S2-S3, defines a sixth plane determined by the position of the virtual audio source and a line of intersection between the fourth and fifth planes, defines an angle between the fourth plane and the sixth plane as a second decomposed angle of the directional line with respect to the vertices S2 and S3, and defines an angle between the fifth plane and the sixth plane as a second decomposed angle of the directional line with respect to the vertices S4 and S1, and uses respective products of cosines of the first decomposed angles and cosines of the second decomposed angles of the vertices as the ratios of the angles between the directional line and the straight lines connecting the sound receiving point and the respective vertices S1, S2, S3, and S4.

In accordance with a third aspect of the invention, there is provided a sound field control apparatus comprising: a storage unit that stores position information of a sound receiving point and respective position information of speakers FLh and FRh mounted at front upper left and right sides of the sound receiving point, speakers FL1 and FR1 mounted at front lower left and right sides of the sound receiving point, speakers BLh and BRh mounted at rear upper left and right sides of the sound receiving point, and speakers BL1 and BR1 mounted at rear lower left and right sides of the sound receiving point; an input unit that inputs an audio signal and position information of a virtual audio source at which the audio signal is to be localized; and a localization controller that localizes the audio signal at a position of the virtual audio source, wherein the localization controller virtually defines a directional region "UP" bordered by a plane p1 determined by the sound receiving point and the speakers FLh and FRh, a plane p2 determined by the sound receiving point and the speakers FRh and BRh, a plane p3 determined by the sound receiving point and the speakers BRh and BLh, and a plane p4 determined by the sound receiving point and the speakers BLh and FLh, a directional region "DOWN" bordered by a plane p5 determined by the sound receiving point and the speakers FL1 and FR1, a plane p6 determined by the sound receiving point and the speakers FR1 and BR1, a plane p7 determined by the sound receiving point and the speakers BR1 and BL1, and a plane p8 determined by the sound receiving point and the speakers BL1 and FL1, a directional region "FRONT" bordered by a plane p9 determined by the sound receiving point and the speakers FLh and FL1, the plane p1, a plane p10 determined by the sound receiving point and the speakers FRh and FR1, and the plane p5, a directional region "REAR" bordered by a plane p11 determined by the sound receiving point and the speakers BRh and BR1, the plane p7, a plane p12 determined by the sound receiving point and the speakers BLh and BL1, and the plane p3, a directional region "LEFT" bordered by the plane p4, the plane p9, the plane p8, and the plane p12, a directional region "RIGHT" bordered by the plane p2, the plane p10, the plane p6, and the plane p1, selects one of the directional regions through which a directional line directed from the sound receiving point to the virtual audio source passes, selects speakers located at vertices of a pyramid defined by a plurality of the planes bordering the selected directional region as speakers to which the audio signal is output, and determines ratios of levels of the audio signal to be provided to the speakers based on ratios of respective angles between the directional line and straight lines connecting the sound receiving point and the selected speakers.

In accordance with a fourth aspect of the invention, the localization controller defines a first plane determined by the sound receiving point and two speakers at vertices S1 and S2 among four speakers provided at vertices S1, S2, S3 and S4 of the pyramid defined by the plurality of the planes bordering the selected directional region and a second plane determined by the sound receiving point and the other two speakers at vertices S3 and S4, defines a third plane determined by the position of the virtual audio source and a line of intersection between the first and second planes, defines an angle between the first plane and the third plane as a first decomposed angle of the directional line with respect to the vertices S1 and S2 and defines an angle between the second plane and the third plane as a first decomposed angle of the directional line with respect to the vertices S3 and S4, defines a fourth plane determined by the sound receiving point and the speakers at vertices S2 and S3 among the four speakers and a fifth plane determined by the sound receiving point and the other two speakers at vertices S4 and S1, defines a sixth plane determined by the position of the virtual audio source and a line of intersection between the fourth and fifth planes, defines an angle between the fourth plane and the sixth plane as a second decomposed angle of the directional line with respect to the vertices S2 and S3 and defines an angle between the fifth plane and the sixth plane as a second decomposed angle of the directional line with respect to the vertices S4 and S1, and uses respective products of cosines of the first decomposed angles and cosines of the second decomposed angles of the vertices as the ratios of the angles between the directional line and the straight lines connecting the sound receiving point and the respective vertices S1, S2, S3, and S4.

According to the invention, it is possible to control height localization of the virtual audio source so that it is possible to reproduce a sound field providing better realism. When a plurality of virtual audio sources is reproduced, it is possible to localize each virtual audio source at a different height position so that listeners more readily perceive broadening of the sound field in a vertical direction, and it is thus possible to enjoy listening sensation effects close to those of real-world sound fields.

Accordingly, it is possible to establish a sound field close to a real-world sound field through sound field reproduction based on actual measurements, and it is also possible to increase the degree of freedom of sound field design when designing the sound field based on simulations or the like.

DETAILED DESCRIPTION OF THE INVENTION

An audio system according to embodiments of the invention will now be described with reference to the accompanying drawings. This audio system includes 8 speakers that are disposed at different heights in three dimensions and an audio device that provides an audio signal to the 8 speakers. The position of a sound receiving point, i.e., ears of the listener, is included in an approximately rectangular solid space defined by the 8 speakers. Four (or three) speakers are selected based on the localization position of an input audio signal (i.e., the position of a virtual audio source) and the audio signal is output through the selected speakers at appropriate ratios of output levels, thereby sterically localizing the audio signal (the virtual audio source) at a three-dimensional point.

<Speaker Arrangement>

Figure 1:
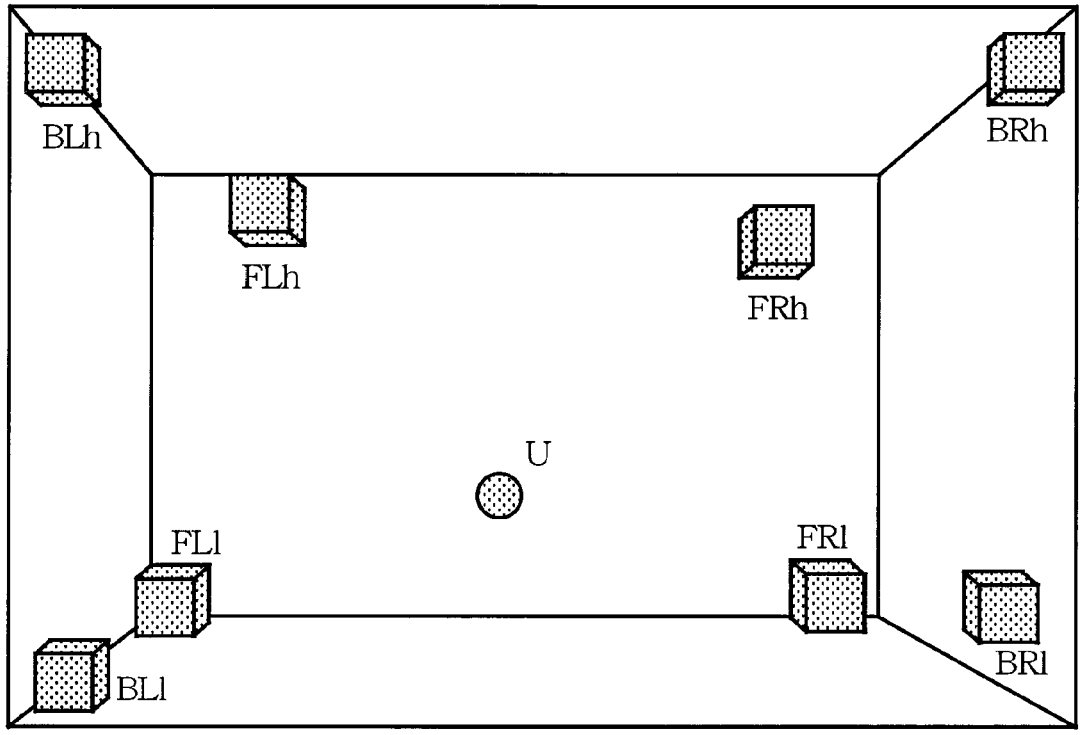
FIG. 1 illustrates an example layout of speakers of an audio system according to an embodiment of the invention.
Figure 3:
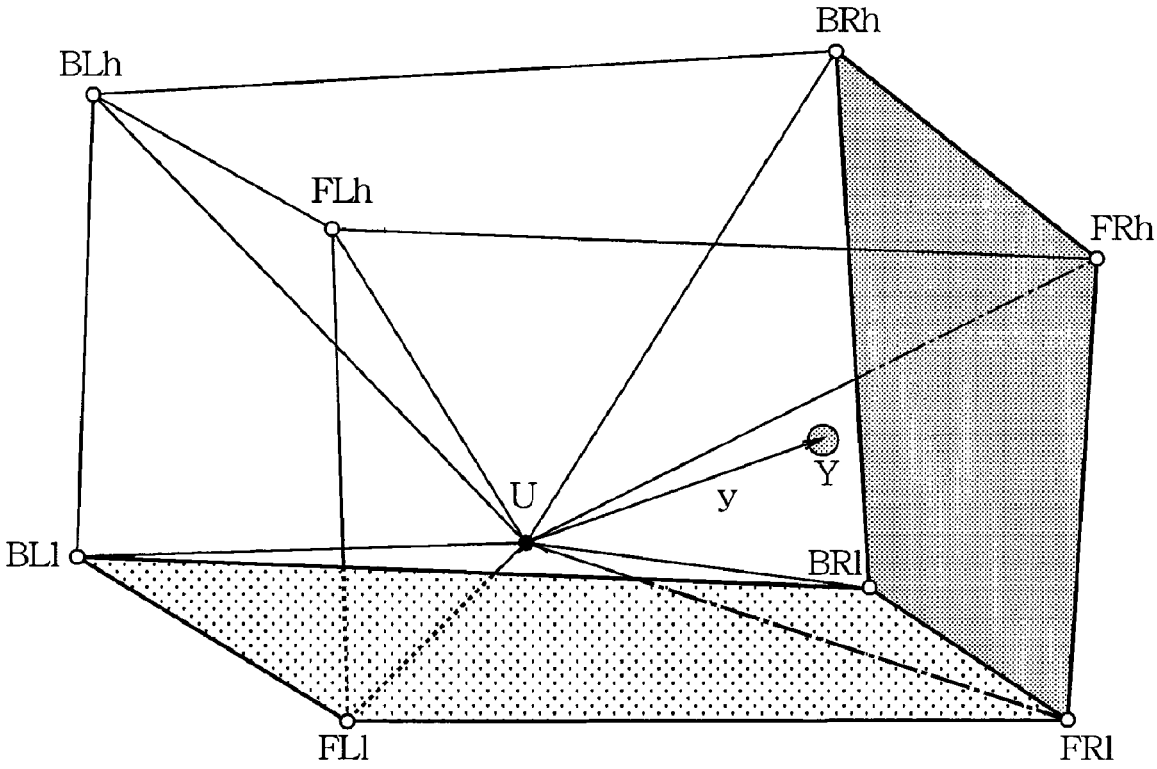
FIG. 3 illustrates a line diagram of the speaker layout to explain directional regions.

FIG. 1 illustrates an example speaker arrangement of the audio system. Speakers FLh and FRh are mounted at front upper left and right portions in a listening room, speakers FL1 and FR1 are mounted at front lower left and right portions in the listening room, speakers BLh and BRh are mounted at rear upper left and right portions in the listening room, and speakers BL1 and BR1 are mounted at rear lower left and right portions in the listening room. Although a solid defined by connecting the mounting positions of the speakers is ideally a rectangular solid (cube), actually, the solid defined by connecting the mounting positions is mostly deformed as shown in FIG. 3 due to constraints such as the shape of the listening room.

Among the 8 speakers, the speakers FL1 and FR1 mounted at the front lower left and right portions in the listening room and the speakers BL1 and BR1 mounted at the rear lower left and right portions are located at heights that are equal to or less than that of a sound receiving point U (i.e., the ears of the listener), and the speakers FLh and FRh mounted at the front upper left and right portions in the listening room and the speakers BLh and BRh mounted at the rear upper left and right portions are located at heights that are greater than that of the sound receiving point U. In this arrangement, the sound receiving point U is included in the solid (space) defined by connecting the 8 speakers.

<Audio Device>

Figure 2:
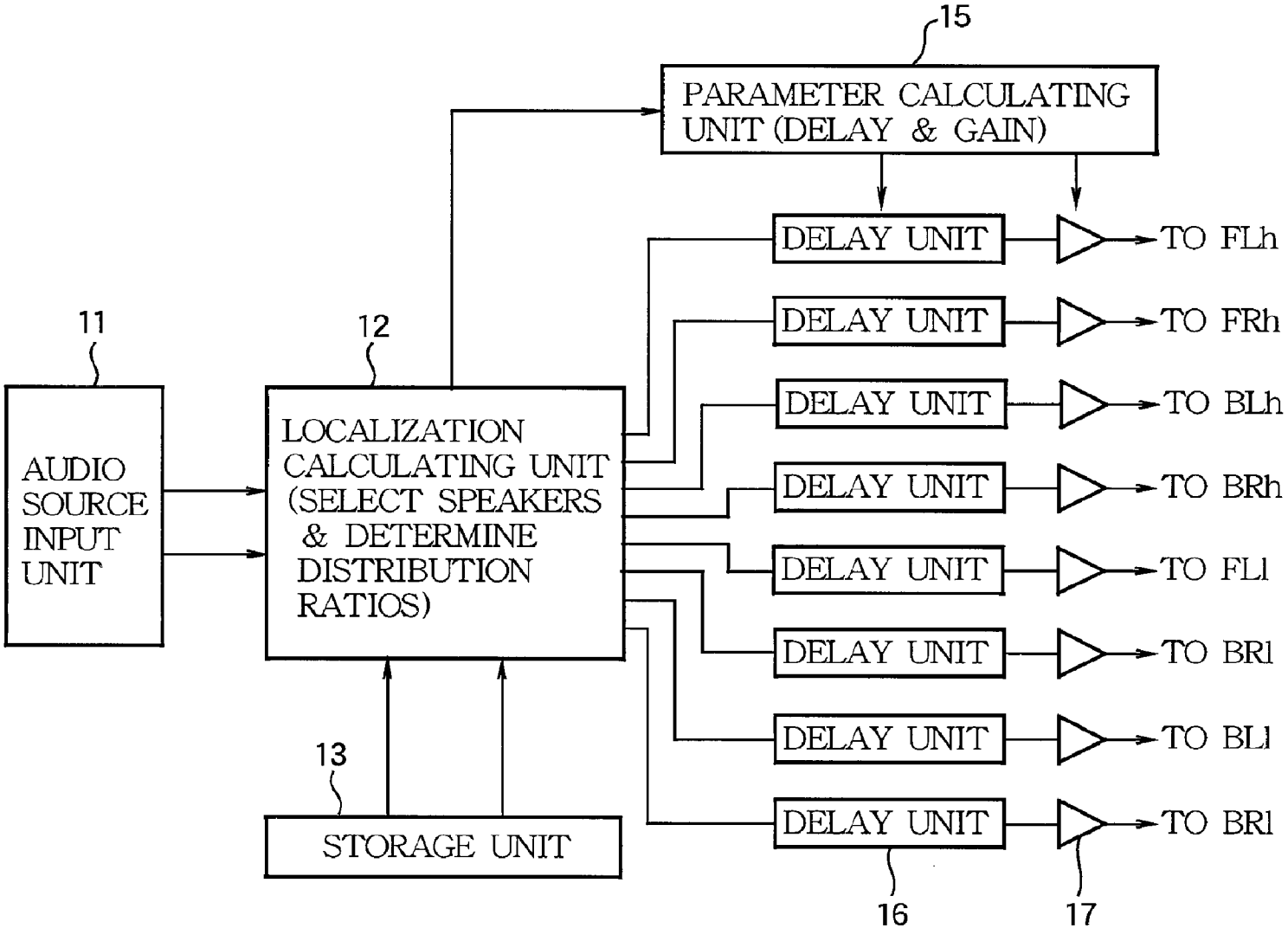
FIG. 2 is a schematic block diagram of a sound field control apparatus in the audio system according to the embodiment of the invention.

FIG. 2 is a schematic block diagram of an audio device that is a sound field control apparatus providing audio signals to the group of 8 speakers shown in FIG. 1. The audio source input unit 11 inputs a plurality of audio signals (virtual audio sources) localized at different positions to the localization calculating unit 12. The audio source input unit 11 also inputs virtual audio source position information, which is information regarding positions at which the audio signals (virtual audio sources) are to be localized, to the localization calculating unit 12. The virtual audio source position information is three-dimensional (3D) position information.

The localization calculating unit 12 selects four speakers from the 8 speakers based on the localization information of each audio signal input from the audio source input unit 11. The localization calculating unit 12 also divides the level of the audio signal into levels for output to the selected speakers and outputs the audio signal at the divided levels to the selected speakers. How the four speakers are selected and how the level of the audio signal is divided into levels for output to the selected speakers will be described in detail.

For this speaker selection and the signal level division, the localization calculating unit 12 receives respective position information of the 8 speakers and position information of the sound receiving point U from a storage unit 13. To measure the position information of the speakers and the position information of the sound receiving point U, each of the speakers outputs a test sound and one or more microphones located near the sound receiving point receive the test sound. Here, it is assumed that the measurement was previously performed and the position information obtained through the measurement has been stored in the storage unit 13.

The position information of each speaker is not necessarily obtained through automatic measurement using the test sound, and any procedure may be employed to store information indicating the current mounting positions of the speakers in the storage unit 13. For example, the user may measure the positions of the speaker using a measuring device and manually input the measured positions. Alternatively, the sound field control apparatus may automatically write the mounting positions of the speakers to the storage unit 13 and set the mounting positions for the user so that the user mounts the speakers at the specified positions.

It is possible to achieve a certain extent of localization effects if the position information stored in the storage unit 13 approximates the actual mounting positions of the speakers even when the stored position information does not exactly match the actual mounting positions. Therefore, even though a hexahedron, whose corners correspond to the positions at which the user mounts the speakers, is not a cube, position information indicating that the speakers are arranged at vertices of a cube approximating the hexahedron may be stored in the storage unit 13 to facilitate calculations.

The localization calculating unit 12 is connected to 8 pairs of delay units 16 and amplifiers 17 corresponding to the 8 speakers. The localization calculating unit 12 outputs audio signals to delay units 16 corresponding to the selected speakers. Based on the localization position of the virtual audio source, the mounting position of a corresponding speaker, and the position of the sound receiving point U, each of the delay units 16 delays the audio signal to be output to the corresponding speaker so that a sound generated by the speaker reaches the sound receiving point U with a delay time corresponding to a distance of the sound receiving point U from the virtual audio source. The amplifier 17 provided downstream of the delay unit 16 attenuates the audio signal in order to achieve attenuation of the signal according to the distance.

A parameter calculating unit 15 calculates the delay time of each delay unit 16 and the gain of each amplifier 17. The parameter calculating unit 15 receives information, such as the localization position of the virtual audio source, information indicating the selected speakers, the mounting positions of the selected speakers, and the position of the sound receiving point U, from the localization calculating unit 12. The parameter calculating unit 15 calculates the delay time and the gain based on the information received from the localization calculating unit 12.

The audio signal is output to each speaker after the audio signal is distributed by the localization calculating unit 12, delayed by each delay unit 16, and amplified (or attenuated) by each amplifier 17. A power amplifier that drives the speakers may be included in the sound field control apparatus or may also be embedded in each of the speakers.

Although the audio source input from the audio source input unit 11 to the localization calculating unit 12 includes a plurality of audio signals (a plurality of virtual audio sources), the following description will be given of processing one audio signal (one virtual audio source). When a plurality of audio signals is processed, the processing described below may be performed on the plurality of audio signals in parallel (or in a time division manner).

<Localization Control>

How the localization calculating unit 12 operates as a localization controller to select speakers and to calculate ratios of levels of the audio signal distributed to the selected speakers will now be described in detail. Each audio signal (virtual audio source) includes virtual audio source position information that is 3D information indicating where a sound image is localized. Based on the virtual audio source position information and the respective position information of the speakers and the sound receiving point, the localization calculating unit 12 determines speakers to which the audio signal is to be assigned among the 8 speakers, and calculates respective ratios of levels of the audio signal to be input to the determined speakers (to the total level of the audio signal). The calculation method is divided into two types of calculation methods as described below and the localization calculating unit 12 may perform any of the two types of calculation methods.

<Method 1>

FIG. 3 is a line diagram illustrating the speaker arrangement shown in FIG. 1. Connecting each pair of neighboring speaker positions to each other with a straight line defines a solid similar in shape to a hexahedron having vertices at the positions of the 8 speakers. Here, while a hexahedron (polyhedron) is a solid with six faces, the solid defined by connecting the 8 speakers with straight lines as shown in FIG. 3 is a hexahedron-like solid since the faces of the solid defined by connecting the 8 speakers with straight lines are not necessarily planes.

In this space, a plane is defined for each side of the hexahedron-like solid of FIG. 3 such that the plane includes the sound receiving point U and a pair of speakers located at both ends of the side and is bounded by a triangle defined by connecting the sound receiving point U and the two speakers with straight lines. A total of 12 planes are defined since the hexahedron-like solid has 12 sides.

The pair of speakers may be selected by selecting two speakers that are assigned respective symbols having two common characters. That is, each speaker is assigned a symbol including three characters (for example, FLh) where the first character "F" or "B" indicates whether the speaker is located at a front or rear position, the second "L" or "R" indicates whether the speaker is located at a left or right position, and the third "h" or "l" indicates whether the speaker is located at a higher or lower position.

Selecting two speakers assigned respective symbols having two common characters consequently obtains a total of 12 pairs of speakers and the following 12 planes are defined accordingly.

Plane p1: FLh, FRh, U (sound receiving point)
Plane p2: FRh, BRh, U
Plane p3: BRh, BLh, U
Plane p4: BLh, FLh, U
Plane p5: FL1, FR1, U
Plane p6: FR1, BR1,U
Plane p7: BR1, BL1, U
Plane p8: BL1, FL1, U
Plane p9: FLh, FL1, U
Plane p10: FRh, FR1, U Plane p11 BRh, BR1, U Plane p12: BLh, BL1, U Then, the following 6 directional regions are defined by the 12 planes.

Directional Region "UP" bordered by Planes p1, p2, p3, and p4

Directional Region "DOWN" bordered by Planes p5, p6, p7, and p8

Directional Region "FRONT" bordered by Planes p9, p1, p10, and p5

Directional Region "REAR" bordered by Planes p11, p7, p12, and p3

Directional Region "LEFT" bordered by Planes p4, p9, p8, and p12

Directional Region "RIGHT" bordered by Planes p2, p10, p6,and p11

Speakers to which the audio signal of the virtual audio source Y are output are selected based on a directional region through which a directional line y, which is directed from the sound receiving point U to the virtual audio source Y (i.e., in a direction of the virtual audio source Y when viewed from the sound receiving point U), passes among the directional regions "FRONT", "REAR", "LEFT", "RIGHT", "UP", and "DOWN". That is, since each direction region is defined by four speakers, four speakers defining the direction region including the directional line y are selected as speakers to which the audio signal of the virtual audio source is distributed. In the example of FIG. 3, the speakers FRh, FR1, BRh, and BR1 are selected as speakers to which the audio signal is output since the directional line y passes through the direction region "RIGHT".

The directional regions "FRONT", "REAR", "LEFT", "RIGHT", "UP", and "DOWN" can be considered regions that are defined by the faces of the hexahedron-like solid defined by the 8 speakers and a directional line passing through a directional region can be considered a line directed to a face corresponding to the directional region. For example, a directional line passing through the directional region "FRONT" can be considered a directional line directed to a face having vertices at FLh, FRh, FR1, and FL1.

When the four speakers to which the audio signal is distributed are determined, the localization calculating unit 12 determines respective signal levels allocated to the four speakers based on ratios of angles between the speakers and the virtual audio source Y when viewed from the sound receiving point U. Accordingly, for the sound receiving point U, a sound image of the virtual audio source is localized at a position based on the virtual audio source position information.

A method for determining the ratios of signal levels allocated to the selected speakers, i.e., a method for distributing signal power to the selected speakers will now be described in detail with reference to FIGS. 4A and 4B. Four planes defining the directional region including the directional line y are denoted as follows.

Pf: Plane defining the upper (or front) border of the region when the virtual audio source Y is viewed from the sound receiving point U Pb: Plane defining the lower (or rear) border of the region when the virtual audio source Y is viewed from the sound receiving point U P1: Plane defining the left border of the region when the virtual audio source Y is viewed from the sound receiving point U Pr: Plane defining the right border of the region when the virtual audio source Y is viewed from the sound receiving point U In the example of FIG. 3, the plane Pf is an extension of the plane p2 exceeding the triangular boundaries of the plane p2, the plane Pb is an extension of the plane p6, the plane P1 is an extension of the plane p10, and the plane Pr is an extension of the plane p11.

Figure 4A:
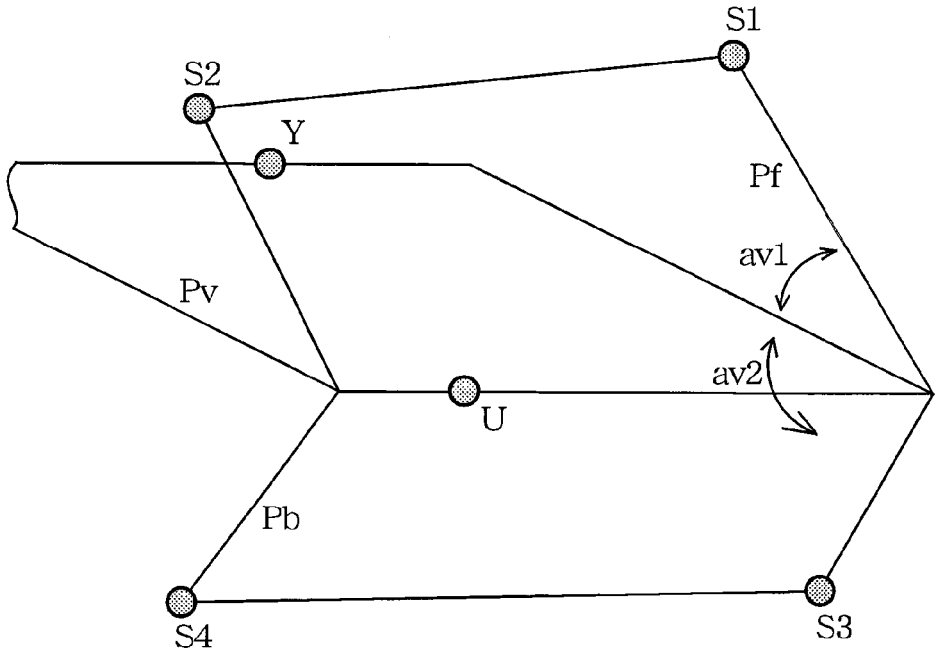
FIGS. 4A and 4B illustrate various angles for calculating level ratios of speakers in a level ratio calculation method 1.
Figure 4B:
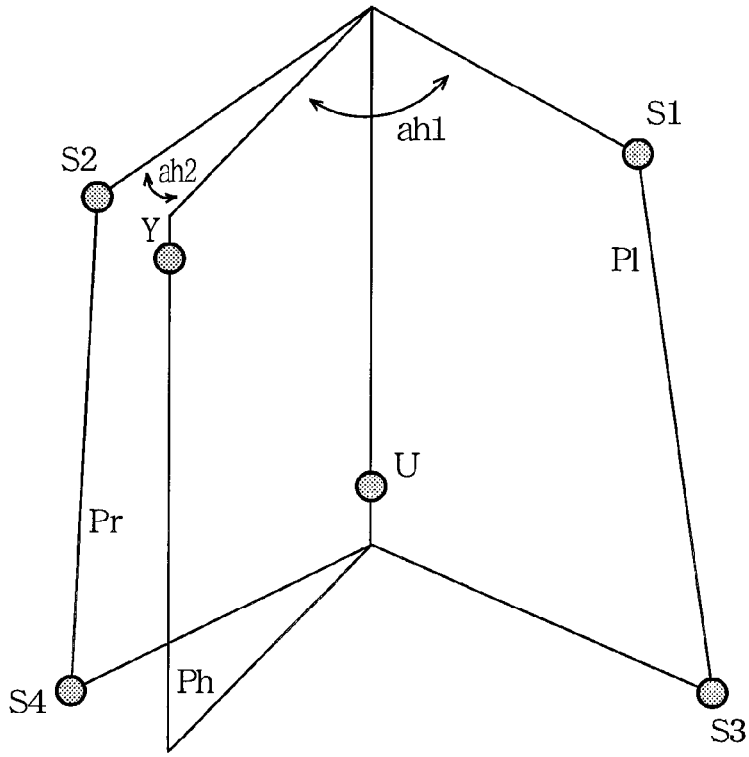

The four speakers defining the region, i.e., the four speakers selected for outputting the audio signal thereto, are represented by "S1" to "S4" as shown in FIGS. 4A and 4B. In the example of FIG. 3, "S1" corresponds to the speaker FRh, "S2" corresponds to the speaker BRh, "S3" corresponds to the speaker FR1, and "S4" corresponds to the speaker BR1.

FIG. 4A illustrates the plane Pf defining the upper border of the region when the virtual audio source Y is viewed from the sound receiving point U and the plane Pb defining the lower border of the region when the virtual audio source Y is viewed from the sound receiving point U. In FIG. 4A, a plane Pv including the virtual audio source Y and a line of intersection of the planes Pf and Pb is defined to obtain angles "av1" and "av2" as follows.

av1: Angle between Pf and Pv.

av2: Angle between Pb and Pv.

FIG. 4B illustrates the plane P1 defining the left border of the region when the virtual audio source Y is viewed from the sound receiving point U and the plane Pr defining the right border of the region when the virtual audio source Y is viewed from the sound receiving point U. In FIG. 4B, a plane Ph including the virtual audio source Y and a line of intersection of the planes P1 and Pr is defined to obtain angles "ah1" and "ah2" as follows.

ah1: Angle between P1 and Ph.

ah2: Angle between Pr and Ph.

In this level ratio calculation procedure, "av1" is a vertical angle component between a direction of the virtual audio source Y and a direction of the speakers S1 and S2 when viewed from the sound receiving point U and "av2" is a vertical angle component between the direction of the virtual audio source Y and a direction of the speakers S3 and S4 when viewed from the sound receiving point U. In addition, "ah1" is a horizontal angle component between the direction of the virtual audio source Y and a direction of the speakers S1 and S3 when viewed from the sound receiving point U and "ah2" is a horizontal angle component between the direction of the virtual audio source Y and a direction of the speakers S2 and S4 when viewed from the sound receiving point U. Based on the angle components obtained in this manner, level factors SS1 to SS4, which are the respective ratios of levels of the signal distributed to the speakers S1 to S4 (to the total level of the signal), are obtained as follows.

$$SS1=\cos((av1/(av1+av2))\times 90)\times\cos((ah1/(ah1+ah2))\times 90)$$

$$SS2=\cos((av1/(av1+av2))\times 90)\times\cos((ah2/(ah1+ah2))\times 90)$$

$$SS3=\cos((av2/(av1+av2))\times 90)\times\cos((ah1/(ah1+ah2))\times 90)$$

$$SS4=\cos((av2/(av1+av2))\times 90)\times\cos((ah2/(ah1+ah2))\times 90)$$

The products of the input audio signal and the level factors SS1 to SS4 are provided respectively to the speakers S1 to S4, thereby localizing the virtual audio source in a direction (or at a position) indicated by the virtual audio source localization information. The sense of distance of the virtual audio source from the sound receiving point U is controlled by the delay units 16 and the amplifiers 17 provided downstream of the localization calculating unit 12. Here, since the sum of respective squares of all the level factors SS1 to SS4 is always 1, the power of the input audio signal is conserved and the volume is not increased or decreased depending on the localized direction of the virtual audio source.

In this calculation method, the signal levels are distributed by normalizing both the angle sums (av1+av2) and (ah1+ah2) to 90 degrees. That is, through calculation of "(av1/(av1+av2))×90", the cosine value when the angle sum (av1+av2) is 90 degrees is obtained while maintaining the ratio of the angles av1 and av2. Since a calculation performed for distributing the signal levels while maintaining the total power of the audio signal when each of the angle sums (av1+av2) and (ah1+ah2) is not 90 degrees is complicated, the angle sums (av1+av2) and (ah1+ah2) are normalized to facilitate the calculation although it causes a small error.

<Method 2>

This method is a level ratio calculation method that can be applied when the upper speakers FLh, FRh, BLh, and BRh are in the same plane and the lower speakers FL1, FR1, BL1, and BR1 are in the same plane and the two planes are parallel to each other. If 8 speakers are in an arrangement close to an arrangement satisfying these requirements even though the arrangement of the 8 speakers does not exactly satisfy the requirements, this method can be applied by approximating the arrangement of the 8 speakers so as to satisfy the requirements.

In this method, the order of calculation processes varies depending on the direction of a directional line y connecting a sound receiving point U to a virtual audio source Y. Therefore, 8 planes, each of which includes two speakers and the sound receiving point and is bounded by straight lines connecting the two speakers and the sound receiving point U, are defined as follows.

Plane p1: FLh, FRh, U (sound receiving point)
Plane p2: FRh, BRh, U
Plane p3: BRh, BLh, U
Plane p4: BLh, FLh, U
Plane p5: FL1, FR1, U
Plane p6: FR1, BR1, U
Plane p7: BR1, BL1, U
Plane p8: BL1, FL1, U Then, the following two directional regions "UP" and "DOWN" are defined by the 8 planes.

Directional Region "UP" bordered by Planes p1, p2, p3, and p4

Directional Region "DOWN" bordered by Planes p5, p6, p7, and p8

Level ratios (level factors) are selected according to a condition which the directional line y connecting the sound receiving point U to the virtual audio source Y satisfies.

Condition 1: The directional line y is included in the directional region "UP".

Condition 2: The directional line y is included in the directional region "DOWN".

Condition 3: The directional line y is not included in any of the regions specified in Conditions 1 and 2.

<When Condition 1 is Satisfied>

Figure 5A:
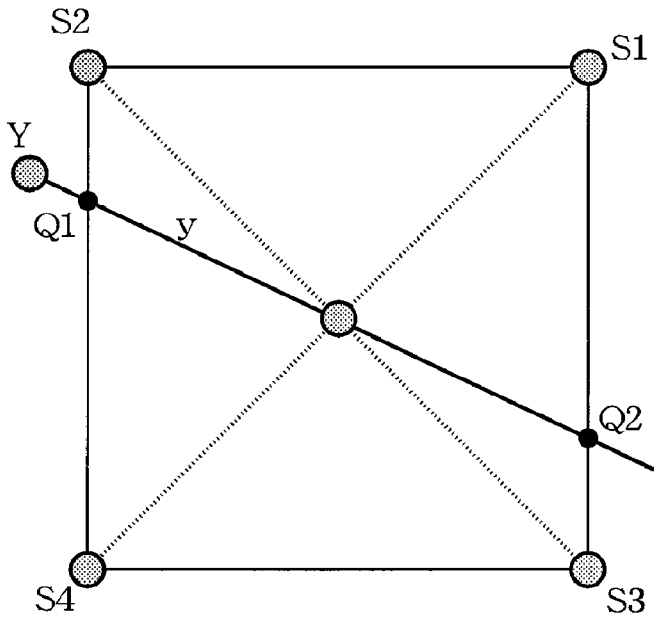
FIGS. 5A and 5B illustrate a level ratio calculation method 2.
Figure 5B:
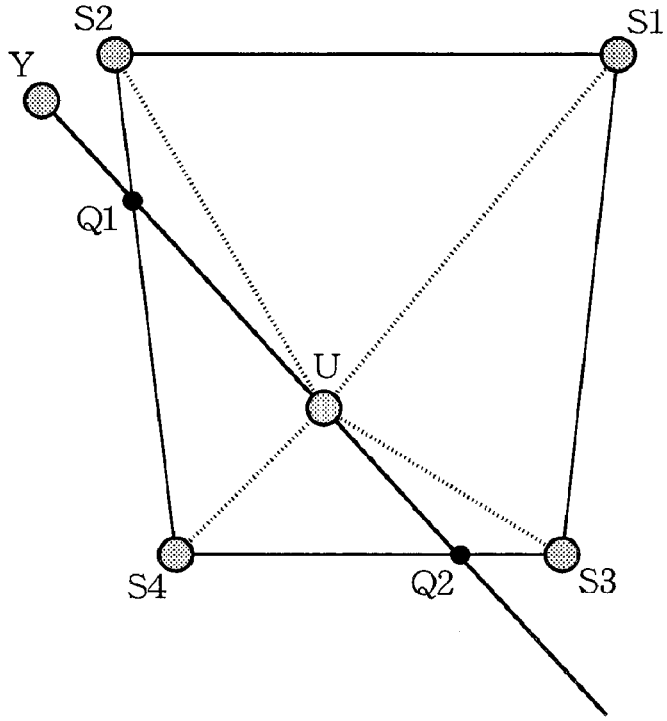

FIG. 5A illustrates a method for calculating level ratios when Condition 1 is satisfied. Selected speakers are represented by "S1" to "S4" as shown in FIGS. 5A and 5B. That is, when the directional region "UP" is selected, "S1" corresponds to the speaker FRh, "S2" corresponds to the speaker FLh, "S3" corresponds to the speaker BRh, and "S4" corresponds to the speaker BLh.

A vertical plane which includes the directional line y and is perpendicular to a plane "pu" (FLh-FRh-BLh-BRh) is defined and points of intersection Q1 and Q2 between this vertical plane and sides (FLh-FRh-BLh-BRh) of the plane "pu" are obtained as follows.

Figure 6:
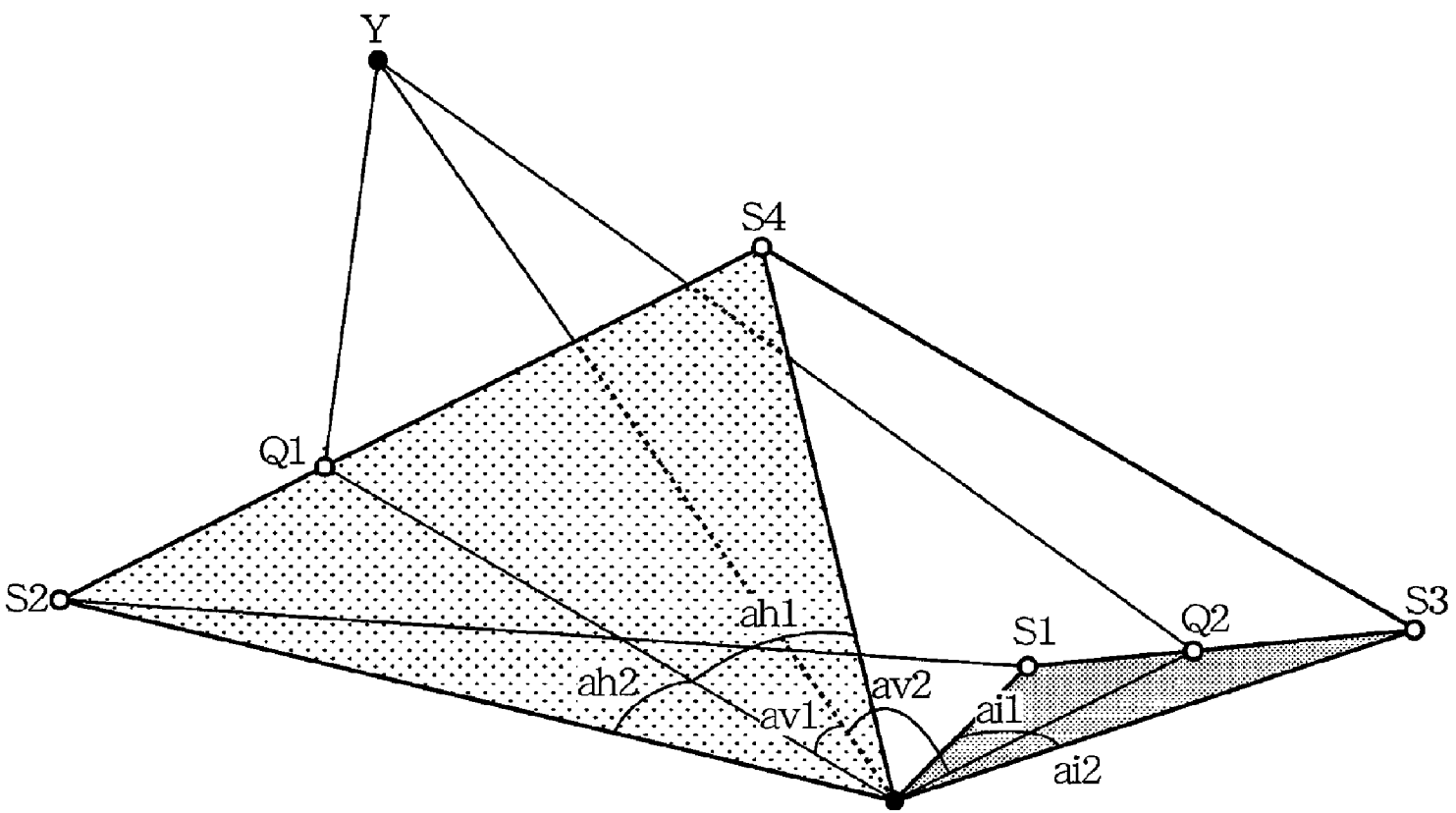
FIG. 6 illustrates various angles for calculating level ratios of speakers in the level ratio calculation method 2.

Q1: Point of intersection at the side of the virtual audio source Y when viewed from the sound receiving point U Q2: Point of intersection at the side opposite the virtual audio source Y when viewed from the sound receiving point U The following angles as shown in FIG. 6 are obtained based on the intersection points Q1 and Q2 obtained as described above, the speakers S1 to S4, the sound receiving point U, the virtual audio source Y, and the directional line y connecting the sound receiving point U and the virtual audio source Y.

av1: Angle between the directional line y and a line of intersection between a plane including S2, S4, and U and the vertical plane including directional line y av2: Angle between the directional line y and a line of intersection between a plane including S1, S3, and U and the vertical plane including directional line y ah1: Angle between a straight line connecting S4 and U and a straight line connecting Q1 and U ah2: Angle between a straight line connecting S2 and U and the straight line connecting Q1 and U ai1: Angle between a straight line connecting S1 and U and a straight line connecting Q2 and U ai2: Angle between a straight line connecting S3 and U and the straight line connecting Q2 and U Using these angles as angle components between the virtual audio source Y and the speakers when viewed from the sound receiving point U, level factors SS1 to SS4 are obtained according to the following equations.

$$SS1=\cos((av2/(av1+av2))\times 90)\times\cos((ai1/(ai1+ai2))\times 90)$$

$$SS2=\cos((av1/(av1+av2))\times 90)\times\cos((ah2/(ah1+ah2))\times 90)$$

$$SS3=\cos((av2/(av1+av2))\times 90)\times\cos((ai2/(ai1+ai2))\times 90)$$

$$SS4=\cos((av1/(av1+av2))\times 90)\times\cos((ah1/(ah1+ah2))\times 90)$$

The products of the input audio signal and the level factors SS1 to SS4 are provided respectively to the speakers S1 to S4, thereby localizing the virtual audio source in a direction indicated by the virtual audio source localization information. The sense of distance of the virtual audio source from the sound receiving point U is controlled by the delay units 16 and the amplifiers 17 provided downstream of the localization calculating unit 12.

Similar to the case of Method 1, since the sum of respective squares of all the level factors SS1 to SS4 is always 1, the power of the input audio signal is conserved and the volume is not increased or decreased depending on the localized direction of the virtual audio source.

In this calculation method, the signal levels are distributed by normalizing both the angle sums (av1+av2) and (ah1+ah2) to 90 degrees. That is, through calculation of "(av1/(av1+av2))×90", the cosine value when the angle sum (av1+av2) is 90 degrees is obtained while maintaining the ratio of the angles av1 and av2. Since a calculation performed for distributing the signal levels while maintaining the total power of the audio signal when each of the angle sums (av1+av2) and (ah1+ah2) is not 90 degrees is complicated, the angle sums (av1+av2) and (ah1+ah2) are normalized to facilitate the calculation although it causes a small error.

<Exceptional Process>

Normally, level ratios are obtained using the above calculation method. However, when a rectangle connecting the speakers S1 to S4 is deformed or when the sound receiving point U is not at the center of the rectangle, the points of intersection Q1 and Q2 may be present on neighboring sides rather than on opposite sides as shown in FIG. 5B. In this case, one of the four selected speakers ("S1" in FIG. 5B) is discarded and the three speakers S2 to S4 are used to output the audio signal.

The level factors of the speakers S2 to S4 in this case are calculated as follows.

av1: Angle between the directional line y and a line of intersection between a plane including S2, S4, and U and the vertical plane including directional line y av2: Angle between the directional line y and a line of intersection between a plane including S4, S3, and U and the vertical plane including directional line y ah1: Angle between a straight line connecting S4 and U and a straight line connecting Q1 and U ah2: Angle between a straight line connecting S2 and U and the straight line connecting Q1 and U ai1: Angle between a straight line connecting S3 and U and a straight line connecting Q2 and U ai2: Angle between a straight line connecting S4 and U and the straight line connecting Q2 and U Using these angles as angle components between the virtual audio source Y and the speakers when viewed from the sound receiving point U, level factors SS1 to SS4 are obtained according to the following equations.

$$SS1=0$$

$$SS2=\cos((av1/(av1+av2))\times 90)\times\cos((ah2/(ah1+ah2))\times 90)$$

$$SS3=\cos((av2/(av1+av2))\times 90)\times\cos((ai1/(ai1+ai2))\times 90)$$

$$SS4b=\cos((av2/(av1+av2))\times 90)\times\cos((ai2/(ai1+ai2))\times 90)$$

$$SS4a=\cos((av1/(av1+av2))\times 90)\times\cos((ah1/(ah1+ah2))\times 90)$$

$$SS4=\sqrt{(S4a\times S4a+S4b\times S4b)}$$

The products of the input audio signal and the level factors SS1 to SS4 are provided respectively to the speakers S1 to S4, thereby localizing the virtual audio source in a direction indicated by the virtual audio source localization information. The sense of distance of the virtual audio source from the sound receiving point U is controlled by the delay units 16 and the amplifiers 17 provided downstream of the localization calculating unit 12.

Similar to the case of Method 1, since the sum of respective squares of all the level factors SS1 to SS4 is always 1, the power of the input audio signal is conserved and the volume is not increased or decreased depending on the localized direction of the virtual audio source.

<When Condition 2 is Satisfied>

When Condition 2 is satisfied, the same procedure as when Condition 1 is satisfied may be performed on the directional region "DOWN". That is, the same processes as when Condition 1 is satisfied are performed using the speakers FL1, FR1, BL1, and BR1 as "S1" to "S4".

<When Condition 3 is Satisfied>

Level ratios are determined using the following method when the directional region including the directional line y is in a direction other than "UP" and "DOWN".

Figure 7:
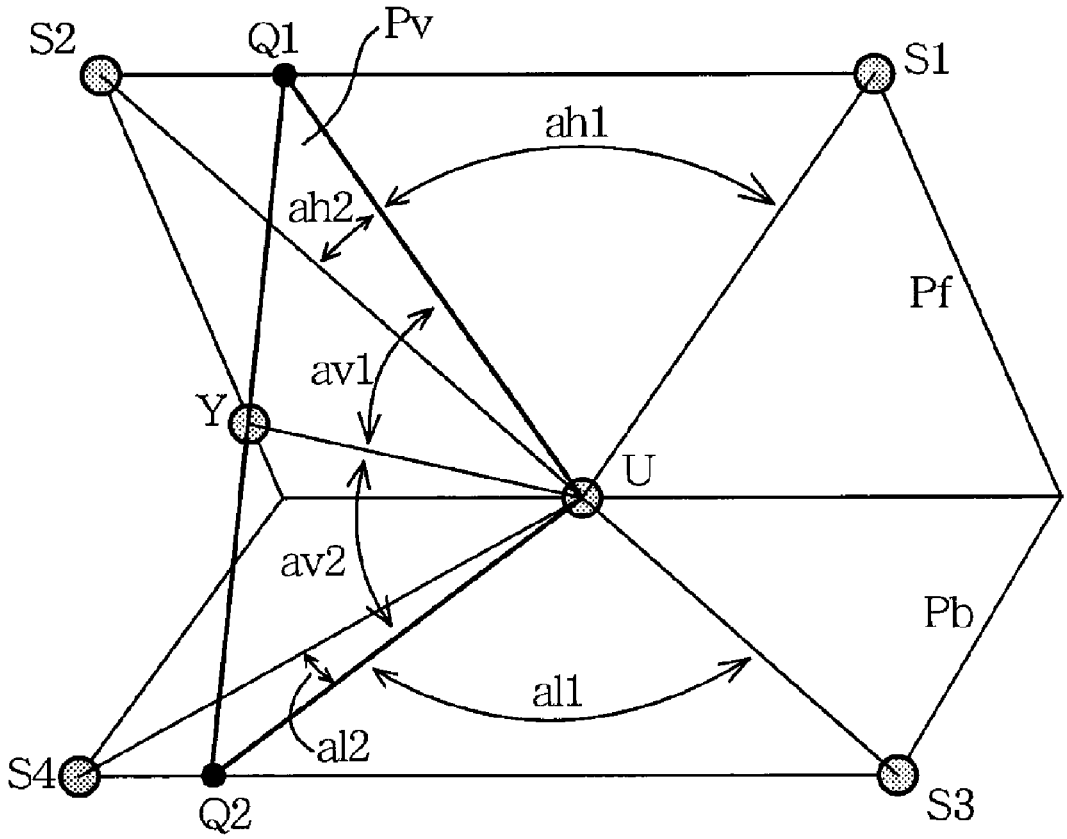
FIG. 7 illustrates various angles for calculating level ratios of speakers in the level ratio calculation method 2.

This method is described below with reference to FIG. 7.

First, a vertical plane Pv, which includes the virtual audio source Y and the sound receiving point U and is perpendicular to the upper and lower planes "pu" and "pd", is defined. Then, a plane, which intersects the vertical plane Pv, is located among the planes p1 to p4 defined above. The located plane is represented by "Pf". A plane, which intersects the vertical plane Pv, is also located among the planes p5 to p8 defined above. The located plane is represented by "Pb".

A point of intersection between the straight line connecting S1 and S2 and the plane Pv is represented by "Q1" and a point of intersection between the straight line connecting S3 and S4 and the plane Pv is represented by "Q2".

The following angles are obtained based on the points obtained in this manner.

av1: Angle between a straight line connecting Q1 and the sound receiving point U and a straight line connecting the virtual audio source Y and the sound receiving point U av2: Angle between a straight line connecting Q2 and the sound receiving point U and the straight line connecting the virtual audio source Y and the sound receiving point U ah1: Angle between a straight line connecting S1 and the sound receiving point U and a straight line connecting Q1 and the sound receiving point U ah2: Angle between a straight line connecting S2 and the sound receiving point U and the straight line connecting Q1 and the sound receiving point U al1: Angle between a straight line connecting S3 and the sound receiving point U and a straight line connecting Q2 and the sound receiving point U al2: Angle between a straight line connecting S4 and the sound receiving point U and the straight line connecting Q2 and the sound receiving point U Using these angles as angle components between the virtual audio source Y and the speakers when viewed from the sound receiving point U, level factors SS1 to SS4 are obtained according to the following equations.

$$SS1=\cos((av1/(av1+av2))\times 90)\times\cos((ah1/(ah1+ah2))\times 90)$$

$$SS2=\cos((av1/(av1+av2))\times 90)\times\cos((ah2/(ah1+ah2))\times 90)$$

$$SS3=\cos((av2/(av1+av2))\times 90)\times\cos((al1/(al1+al2))\times 90)$$

$$SS4=\cos((av2/(av1+av2))\times 90)\times\cos((al2/(al1+al2))\times 90)$$

The products of the input audio signal and the level factors SS1 to SS4 are provided respectively to the speakers S1 to S4, thereby localizing the virtual audio source in a direction indicated by the virtual audio source localization information. The sense of distance of the virtual audio source from the sound receiving point U is controlled by the delay units 16 and the amplifiers 17 provided downstream of the localization calculating unit 12.

Similar to the case of Method 1, since the sum of respective squares of all the level factors SS1 to SS4 is always 1, the power of the input audio signal is conserved and the volume is not increased or decreased depending on the localized direction of the virtual audio source.

In this calculation method, the signal levels are distributed by normalizing both the angle sums (av1+av2) and (ah1+ah2) to 90 degrees. That is, through calculation of "(av1/(av1+av2))×90", the cosine value when the angle sum (av1+av2) is 90 degrees is obtained while maintaining the ratio of the angles av1 and av2. Since a calculation performed for distributing the signal levels while maintaining the total power of the audio signal when each of the angle sums (av1+av2) and (ah1+ah2) is not 90 degrees is complicated, the angle sums (av1+av2) and (ah1+ah2) are normalized to facilitate the calculation although it causes a small error.

Although the above Method 2 has been described with reference to the case where the speakers FLh, FRh, BLh, and BRh mounted at the upper side are in the same plane and the speakers FL1, FR1, BL1, and BR1 mounted at the lower side are in the same plane, Method 2 can also be applied when speakers mounted at each side other than the upper and lower sides are in the same plane. For example, Method 2 can be applied when the four speakers mounted at the front side are in the same plane and the four speakers mounted at the rear side are in the same plane or when the four speakers mounted at the left side are in the same plane and the four speakers mounted at the right side are in the same plane.

Although the above description has been given of the level factor calculation procedure for one virtual audio source, the sound field control apparatus shown in FIG. 2 is constructed such that the audio source input unit 11 inputs an audio source including a plurality of virtual audio sources to the localization calculating unit 12 and the audio source input unit 11 and the processing units downstream thereof perform localization processes of the virtual audio sources in parallel. That is, localization of all virtual audio sources providing a sound field is controlled using Method 1 or Method 2 described above to perform a playback process.

Here, the process for determining speakers to which the audio signal is distributed, the calculation for determining the planes Pv and Ph, and the like are rather complicated although the calculation for sound image localization in Method 1 is common in any direction. In addition, calculations vary depending on the direction of the virtual audio source and speaker arrangement is constrained although calculation processes, including a process for determining speakers to which the audio signal is distributed in Method 2, are relatively simple. Method 1 and Method 2 may be selectively used appropriately based on these features.

Figure 8A:
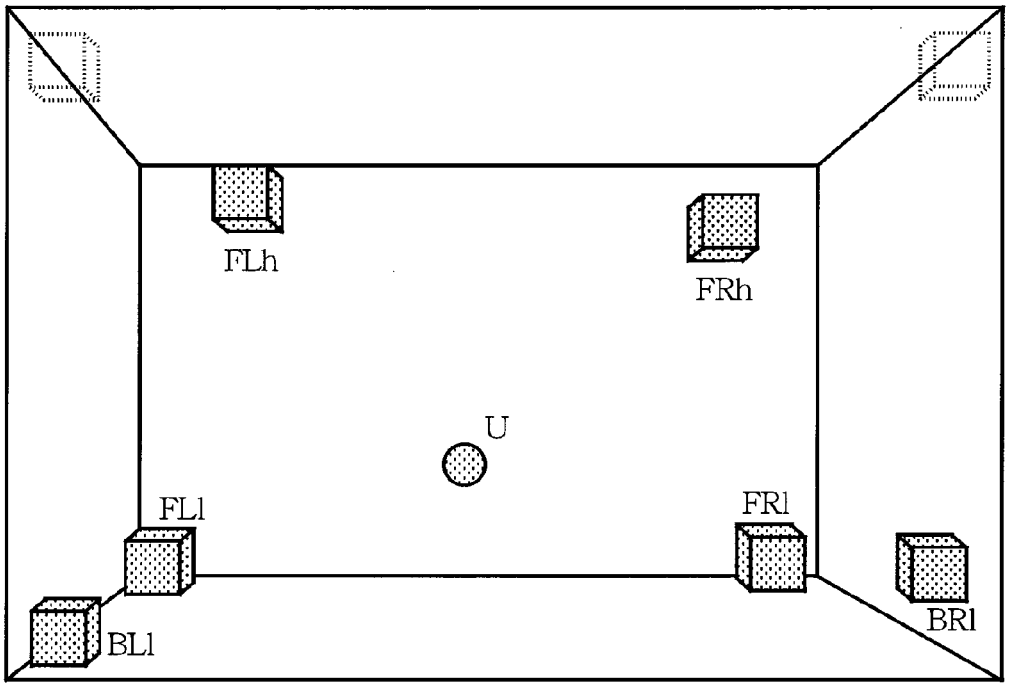
FIGS. 8A and 8B illustrate an example layout of 6 speakers.
Figure 8B:
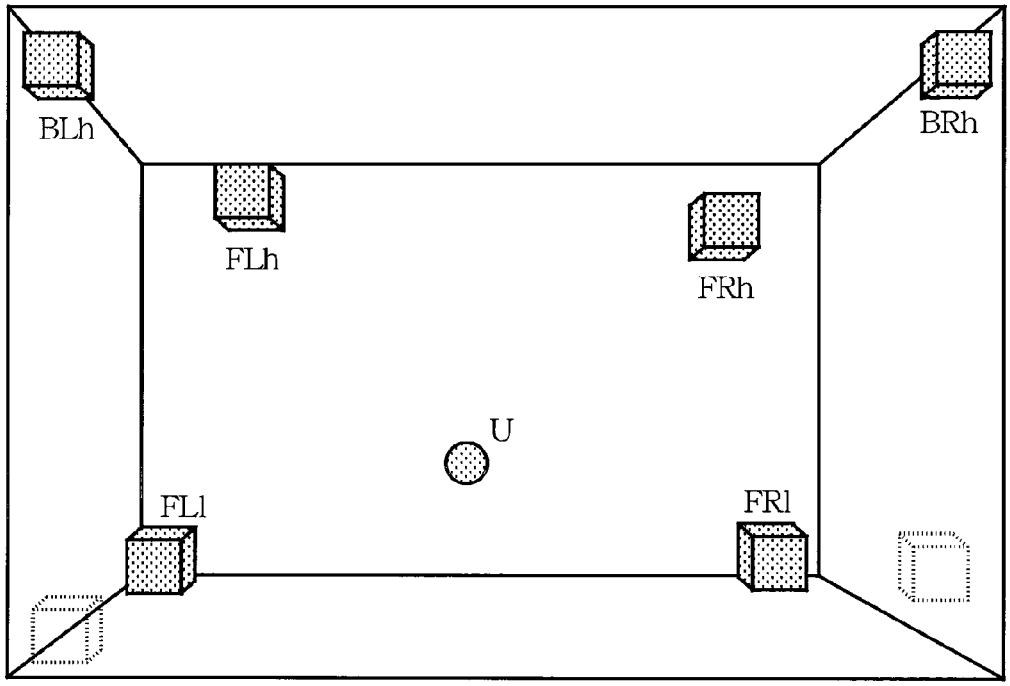

In addition, although the above embodiments have been described with reference to the case where 8 speakers are mounted, the method of the invention can also be applied when 6 speakers are mounted. When the audio system includes 6 speakers, it is assumed that the audio system is constructed such that a pair of left and right speakers L and R is removed from the arrangement of the 8 speakers shown in FIG. 1. Since it is desirable in the case of a general audio (AV) system that the four front upper and lower speakers be provided, it can be considered that the audio system is constructed such that the speakers BLh and BRh are removed as shown in FIG. 8A or that the speakers BL1 and BR1 are removed as shown in FIG. 8A.

When level ratios for localizing virtual audio sources are determined in this speaker arrangement, level factors are calculated for four speakers. However, only three speakers may be selected. In this case, two level factors may be applied to one of the three speakers and this speaker may output an audio signal at a level corresponding to a square root of the two level factors.

In Method 1, it may be assumed that the mounting positions of the pair of speakers BRh and BR1 and the mounting positions of the pair of speakers BLh and BL1 are at the same coordinates as the mounting positions of a pair of actually mounted speakers among the two pairs of speakers and a line of intersection between the plane p11 and the plane p10 is parallel to the side FRh-FR1 and a line of intersection between the plane p12 and the plane p9 is parallel to the side FLh-FL1.

In Method 2, it may be assumed that the speakers BRh and BR1 are arranged in the same vertical plane and the speakers BLh and BL1 are arranged in the same vertical plane.

In this case, virtual audio sources are not accurately localized at a position according to the virtual audio source position information but are instead localized at an approximate position.

What is claimed is:

1. A sound field control apparatus comprising:

a storage unit that stores position information of a plurality of speakers disposed in a three-dimensional space and position information of a sound receiving point of sounds generated from the plurality of the speakers;

an input unit that inputs an audio signal and position information of a virtual audio source at which the audio signal is to be localized; and a localization controller that localizes the audio signal at a position of the virtual audio source, wherein the localization controller defines a virtual solid that is approximately polyhedral and that has vertices at respective positions of the plurality of the speakers, wherein the localization controller selects a face of the virtual solid through which a directional line directed from the sound receiving point to the virtual audio source passes, wherein the localization controller selects speakers located at vertices of the selected face as speakers to which the audio signal is output, and wherein the localization controller determines ratios of levels of the audio signal to be provided to the speakers located at the vertices of the selected face based on ratios of respective angles between the directional line and straight lines directed from the sound receiving point to the vertices of the selected face.

2. The sound field control apparatus according to claim 1, wherein the storage unit stores position information of 8 speakers located respectively at vertices S1, S2, S3, S4 of an approximately rectangular solid having six rectangles, and wherein the localization controller defines a first plane determined by the sound receiving point and a side S1-S2 of a rectangle S1, S2, S3, S4 corresponding to the selected face and a second plane determined by the sound receiving point and an opposite side S3-S4 of the rectangle S1, S2, S3, S4, wherein the localization controller defines a third plane determined by the position of the virtual audio source and a line of intersection between the first and second planes, wherein the localization controller defines an angle between the first plane and the third plane as a first decomposed angle of the directional line with respect to the vertices S1 and S2, and defines an angle between the second plane and the third plane as a first decomposed angle of the directional line with respect to the vertices S3 and S4, wherein the localization controller defines a fourth plane determined by the sound receiving point and a side S2-S3 of the rectangle S1, S2, S3, S4 and a fifth plane determined by the sound receiving point and a side S4-S1 of the rectangle opposite the side S2-S3, wherein the localization controller defines a sixth plane determined by the position of the virtual audio source and a line of intersection between the fourth and fifth planes, wherein the localization controller defines an angle between the fourth plane and the sixth plane as a second decomposed angle of the directional line with respect to the vertices S2 and S3, and defines an angle between the fifth plane and the sixth plane as a second decomposed angle of the directional line with respect to the vertices S4 and S1, and wherein the localization controller uses respective products of cosines of the first decomposed angles and cosines of the second decomposed angles of the vertices S1, S2, S3, and S4 as the ratios of the angles between the directional line and the straight lines connecting the sound receiving point and the respective vertices S1, S2, S3, and S4.

3. A sound field control apparatus comprising:

a storage unit that stores position information of a sound receiving point and respective position information of speakers FLh and FRh mounted at front upper left and right sides of the sound receiving point, speakers FL1 and FR1 mounted at front lower left and right sides of the sound receiving point, speakers BLh and BRh mounted at rear upper left and right sides of the sound receiving point, and speakers BL1 and BR1 mounted at rear lower left and right sides of the sound receiving point;

an input unit that inputs an audio signal and position information of a virtual audio source at which the audio signal is to be localized; and a localization controller that localizes the audio signal at a position of the virtual audio source, wherein the localization controller virtually defines a directional region "UP" bordered by a plane p1 determined by the sound receiving point and the speakers FLh and FRh, a plane p2 determined by the sound receiving point and the speakers FRh and BRh, a plane p3 determined by the sound receiving point and the speakers BRh and BLh, and a plane p4 determined by the sound receiving point and the speakers BLh and FLh, wherein the localization controller virtually defines a directional region "DOWN" bordered by a plane p5 determined by the sound receiving point and the speakers FL1 and FR1, a plane p6 determined by the sound receiving point and the speakers FR1 and BR1, a plane p7 determined by the sound receiving point and the speakers BR1 and BL1, and a plane p8 determined by the sound receiving point and the speakers BL1 and FL1, wherein the localization controller virtually defines a directional region "FRONT" bordered by a plane p9 determined by the sound receiving point and the speakers FLh and FL1, the plane p1, a plane p10 determined by the sound receiving point and the speakers FRh and FR1, and the plane p5, wherein the localization controller virtually defines a directional region "REAR" bordered by a plane p11 determined by the sound receiving point and the speakers BRh and BR1, the plane p7, a plane p12 determined by the sound receiving point and the speakers BLh and BL1, and the plane p3, wherein the localization controller virtually defines a directional region "LEFT" bordered by the plane p4, the plane p9, the plane p8, and the plane p12, wherein the localization controller virtually defines a directional region "RIGHT" bordered by the plane p2, the plane p10, the plane p6, and the plane p11, wherein the localization controller selects one of directional regions through which a directional line directed from the sound receiving point to the virtual audio source passes, wherein the localization controller selects speakers located at vertices of a pyramid defined by a plurality of the planes bordering the selected directional region as speakers to which the audio signal is output, and wherein the localization controller determines ratios of levels of the audio signal to be provided to the speakers based on ratios of respective angles between the directional line and straight lines connecting the sound receiving point and the selected speakers.

4. The sound field control apparatus according to claim 3, wherein the localization controller defines a first plane determined by the sound receiving point and two speakers at vertices S1 and S2 among four speakers provided at vertices S1, S2, S3 and S4 of the pyramid defined by the plurality of the planes bordering the selected directional region, and a second plane determined by the sound receiving point and the other two speakers at vertices S3 and S4, wherein the localization controller defines a third plane determined by the position of the virtual audio source and a line of intersection between the first and second planes, wherein the localization controller defines an angle between the first plane and the third plane as a first decomposed angle of the directional line with respect to the vertices S1 and S2, and defines an angle between the second plane and the third plane as a first decomposed angle of the directional line with respect to the vertices S3 and S4, wherein the localization controller defines a fourth plane determined by the sound receiving point and the speakers at vertices S2 and S3 among the four speakers and a fifth plane determined by the sound receiving point and the other two speakers at vertices S4 and S1, wherein the localization controller defines a sixth plane determined by the position of the virtual audio source and a line of intersection between the fourth and fifth planes, wherein the localization controller defines an angle between the fourth plane and the sixth plane as a second decomposed angle of the directional line with respect to the vertices S2 and S3, and defines an angle between the fifth plane and the sixth plane as a second decomposed angle of the directional line with respect to the vertices S4 and S1, and wherein the localization controller uses respective products of cosines of the first decomposed angles and cosines of the second decomposed angles of the vertices S1, S2, S3, and S4 as the ratios of the angles between the directional line and the straight lines connecting the sound receiving point and the respective vertices S1, S2, S3 and S4.

* * * * *